US006729080B1

(12) United States Patent
Zambelli et al.

(10) Patent No.: US 6,729,080 B1
(45) Date of Patent: May 4, 2004

(54) SUPPORTING DEVICE FOR PREFABRICATED UNITS, IN PARTICULAR FOR CONSTRUCTIONS HAVING A METALLIC STRUCTURE

(76) Inventors: Sergio Zambelli, Via Stezzano, 28, 24050 Zanica (IT); Benito Zambelli, Via Roma, 44, 24050 Zanica (IT)

( * ) Notice: Subject to any disclaimer, the term of this patent is extended or adjusted under 35 U.S.C. 154(b) by 0 days.

(21) Appl. No.: 09/576,133

(22) Filed: May 22, 2000

(51) Int. Cl.[7] ..... E04B 1/98; E04H 9/02

(52) U.S. Cl. ..... 52/167.1; 52/509; 52/235; 52/283; 52/704

(58) Field of Search ..... 52/167.1, 167.4, 52/37, 39, 235, 477, 482, 506.05, 510; 248/342, 343, 200.1, 340, 300, 237, 172; 267/64.15; 182/45, 3, 4, 5, 6, 7

(56) References Cited

U.S. PATENT DOCUMENTS 5,283,992 A 2/1994 Morassutti
5,487,524 A * 1/1996 Bergetz ..... 248/613
5,873,556 A * 2/1999 Reiker ..... 248/342
6,237,884 B1 * 5/2001 Howe ..... 248/200.1

FOREIGN PATENT DOCUMENTS

| | | |
|---|---|---|
| DE | 32 06 099 | 9/1983 |
| DE | 38 31 517 | 3/1990 |
| EP | 0 423 660 | 4/1991 |
| FR | 2 580 696 | 10/1986 |

* cited by examiner

*Primary Examiner*—Carl D. Friedman
*Assistant Examiner*—Chi Q. Nguyen
(74) *Attorney, Agent, or Firm*—Guido Modiano; Albert Josif; Daniel O'Byrne

(57) ABSTRACT

A supporting device for prefabricated units, particularly for buildings having a metallic structure, comprising a main body which can be fixed to an outer face of a first unit and a supporting element which forms, with one of its portions, a resting region for a second unit to be connected to the first unit. The supporting element is detachably associated with the main body and can be moved along the main body in order to vary the position of the resting region with respect to the first unit.

19 Claims, 5 Drawing Sheets

SUPPORTING DEVICE FOR PREFABRICATED UNITS, IN PARTICULAR FOR CONSTRUCTIONS HAVING A METALLIC STRUCTURE

BACKGROUND OF THE INVENTION

The present invention relates to a supporting device for prefabricated units, in particular for buildings having a metallic structure.

Supporting devices for prefabricated units made of concrete or the like are known.

In the field of buildings having a concrete supporting structure, appropriate brackets are sometimes provided in order to support prefabricated units which are also made of concrete, such as for example prefabricated panels; such brackets are formed monolithically with the supporting element or with the supported element, protrude from it, and are meant to engage in seats provided for this purpose in the supported element or in the supporting element, or simply form a resting surface for the supported element or for the supporting element.

Other devices for supporting prefabricated units are constituted by brackets which are rigidly coupled, during installation, by welding or bolting, to steel inserts embedded beforehand in the units.

These supporting devices for prefabricated units have the problem of difficulty in performing installation and of poor precision in positioning the prefabricated unit with respect to the supporting structure.

EP-423,660 in the name of these same Applicants discloses a supporting and anchoring device for prefabricated units in particular made of concrete or the like, which is substantially constituted by a bush-like seat formed in one face of the supporting element and by a supporting element which is detachably inserted in the seat and protrudes from the seat and from the face of the supporting element, so as to form a resting region for the prefabricated unit to be connected to the supporting element.

The device is provided with adjustment means which allow to vary the distance of the resting region with respect to the face of the supporting element and the elevation of the resting region, so as to allow, in a simple and rapid way, a very precise positioning of the prefabricated unit with respect to the supporting structure.

Since this device requires, inside the supporting element, a bush-like seat which must be provided during the production of the supporting element, it cannot be used in buildings having a metallic supporting structure and whenever it is not possible or convenient to form a bush-like seat inside the body of the supporting element, even if said element is made of concrete.

SUMMARY OF THE INVENTION

The aim of the present invention is to provide a supporting device for prefabricated units which does not require the preliminary provision of a bush-like seat inside one of the two units to be mutually connected and accordingly is particularly adapted for use in the field of buildings having a metallic supporting structure.

Within the scope of this aim, an object of the present invention is to provide a device which can in any case be used also to connect prefabricated units made of concrete if it is impossible or not convenient to provide a bush-like seat in one of the two prefabricated units to be mutually connected.

Another object of the present invention is to provide a device which in any case allows very precise adjustment, during installation, of the position of one unit with respect to the other.

Another object of the present invention is to provide a device which allows particularly simple installation of prefabricated units.

Another object of the present invention is to provide a device which offers good resistance in case of seismic events.

These and other objects which will become better apparent hereinafter are achieved by a supporting device for prefabricated units, characterized in that it comprises a main body which can be fixed to an outer face of a first unit and a supporting element having a portion which forms a resting region for a second unit to be connected to said first unit; said supporting element being detachably associated with said main body and-being movable along said main body in order to vary the position of said resting region with respect to said first unit.

BRIEF DESCRIPTION OF THE DRAWINGS

Further characteristics and advantages of the present invention will become better apparent from the following detailed description of preferred but not exclusive embodiments of the device according to the invention, illustrated only by way of non-limitative example in the accompanying drawings, wherein.

DESCRIPTION OF THE PREFERRED EMBODIMENTS

With reference to the above figures, the device according to the invention, in its various embodiments, substantially comprises a main body 2*a*, 2*b*, 2*c*, 2*d*, 2*e*, which can be fixed to an outer face 3 of a first unit 4, and a supporting element 5*a*, 5*b*, 5*c*, 5*d*, 5*e*, which forms, with one of its portions, a resting region 6 for a second unit 7 to be connected to the first unit 4. The supporting element 5*a*, 5*b*, 5*c*, 5*d*, 5*e* is detachably associated with the main body 2*a*, 2*b*, 2*c*, 2*d*, 2*e* and can be moved along the main body in order to allow to vary the position of the resting region 6 with respect to the first unit 4.

The first unit 4 can be constituted by a concrete unit, either of the prefabricated or cast-in-place type, such as for example a pillar, a beam, a floor slab, et cetera, or by an element of a metallic structure.

The second unit 7 can be constituted by a prefabricated unit made of concrete or other material.

Conveniently, the main body 2*a*, 2*b*, 2*c*, 2*d*, 2*e* and the supporting element 5*a*, 5*b*, 5*c*, 5*d*, 5*e* substantially constitute a telescopic structure which has a first portion which can be fixed to the first unit 4 and a second portion which can slide axially with respect to the first portion and forms the resting region 6 for the second unit 7.

The main body 2*a*, 2*b*, 2*c*, 2*d*, 2*e* is preferably substantially cylindrical, with a polygonal transverse cross-section, and the supporting element 5*a*, 5*b*, 5*c*, 5*d*, 5*e* also has a substantially cylindrical body with a polygonal transverse cross-section which couples with play to the main body 2*a*, 2*b*, 2*c*, 2*d*, 2*e*.

Preferably, the supporting element 5*a*, 5*b*, 5*c*, 5*d*, 5*e* has a body which has a tubular structure.

Figure 16:
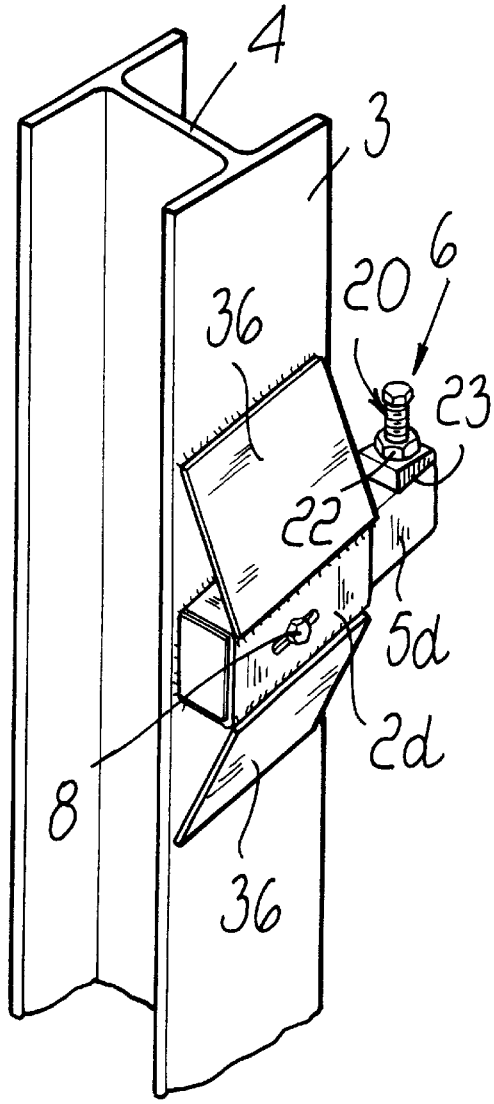
FIG. 16 is a perspective view of the embodiment of the device shown in FIG. 15, with the addition of tie angles.
Figure 17:
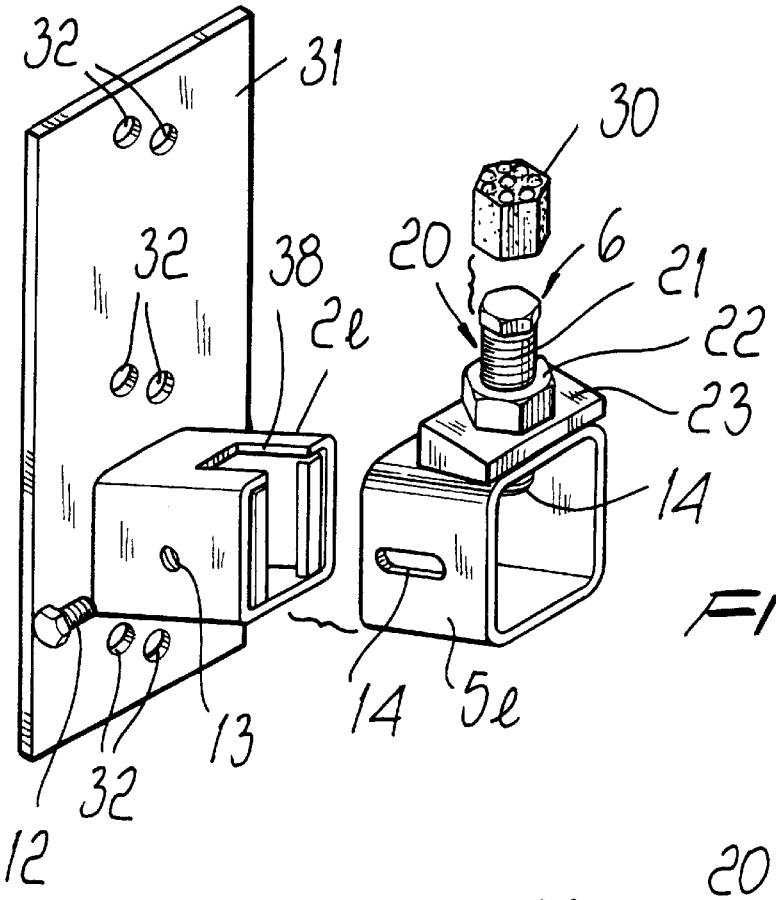
FIG. 17 is an exploded perspective view of a further embodiment of the device according to the invention.
Figure 18:
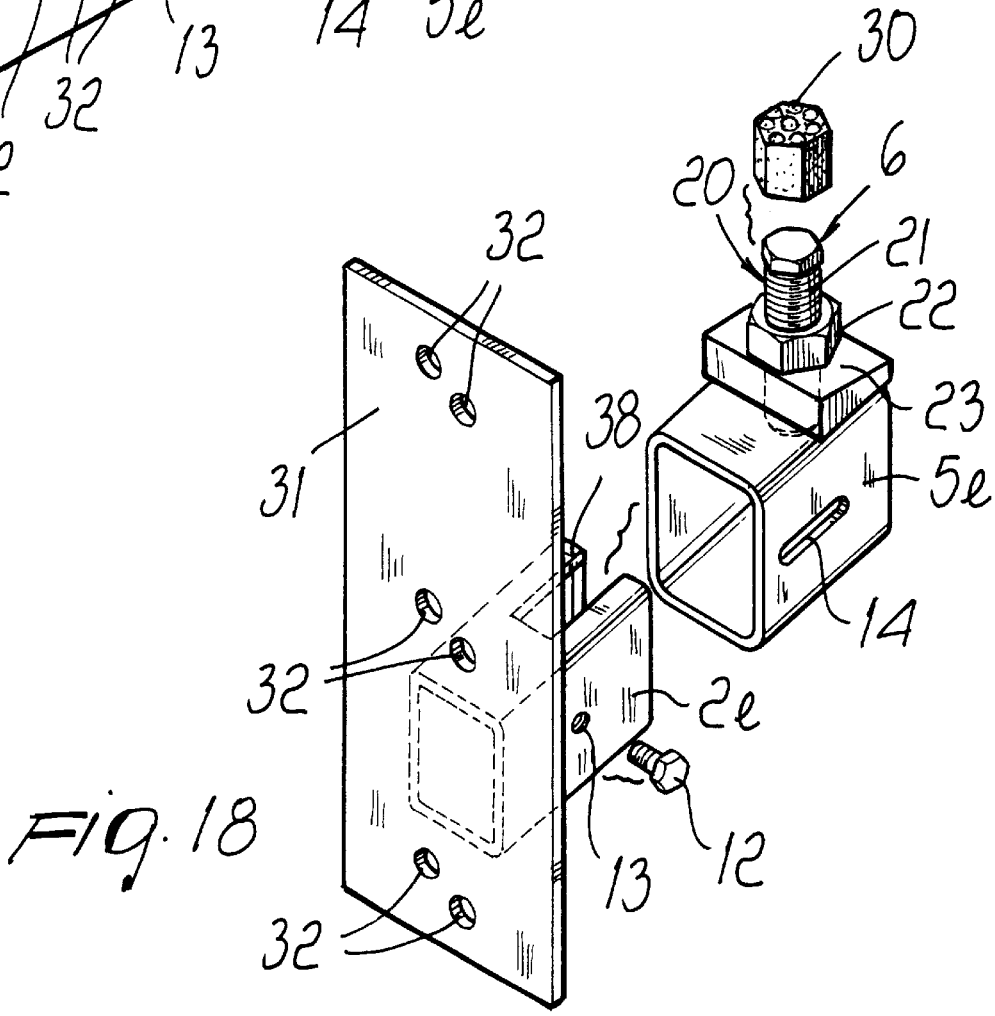
FIG. 18 is a perspective view of the device of FIG. 17, taken from a different angle with respect to FIG. 17.

In the embodiments shown in FIGS. 1 to 16, the supporting element 5*a*, 5*b*, 5*c*, 5*d*, 5*e* is inserted axially, with one of its portions, in the main body 2*a*, 2*b*, 2*c*, 2*d*, while in the embodiment shown in FIGS. 17 and 18 the main body 2*e* is inserted axially, with one of its portions, in the supporting element 5*e*.

The resting region 6 is formed proximate to the end of the supporting element 5*a*, 5*b*, 5*c*, 5*d*, 5*e* that protrudes from the axial dimensions of the main body 2*a*, 2*b*, 2*c*, 2*d*, 2*e*.

The device according to the invention further comprises means for stopping the axial sliding of the supporting element 5*a*, 5*b*, 5*c*, 5*d*, 5*e* with respect to the main body 2*a*, 2*b*, 2*c*, 2*d*, 2*e*.

The stop means comprise a bolt, constituted by a screw 8 and a nut 9, which is arranged transversely to the main body and to the supporting element and passes through a hole 10, which is formed in the portion of the supporting element that is inserted in the main body, and a slot 11, which is axially elongated and passes through the main body.

It is of course possible to provide the slot 11 in the supporting element and the hole 10 in the main body.

As shown in the embodiment of FIGS. 17 and 18, the stop means can also be simply constituted by a screw 12 which is orientated transversely to the axial extension of the main body 2*e* and couples with a threaded hole 13 formed in the main body 2*e*, so as to engage a slot 14 which is elongated in an axial direction and is formed in the supporting element 5*e*.

Even if the stop means are simply constituted by a screw 12, the threaded hole 13 can be formed in the supporting element and the slot 14 can be formed in the main body.

The main body and the supporting element are preferably made of steel.

The main body of the device according to the invention, in the various illustrated embodiments, is meant to be fixed to a face 3 of the first unit 4 so that its longitudinal axis, i.e., the axis along which the supporting element can slide with respect to the main body, lies in a substantially horizontal direction or at an angle to the horizontal so as to rise toward the resting region 6. If the longitudinal axis of the main body is inclined upward with respect to the horizontal, the device according to the invention achieves higher resistance in case of seismic events.

The device according to the invention comprises means for adjusting the elevation of the resting region 6.

Advantageously, the adjustment means comprise a screw element 20 which protrudes in a substantially vertical direction and is associated with the supporting element. The screw element 20 forms, with its end that protrudes from the supporting element, the resting region 6 for the second unit 7 and its useful length can vary so as to vary the elevation of the resting region 6.

More particularly, the screw element 20 comprises a threaded stem 21 which couples to a female thread which is formed inside a nut 22 which is welded onto the portion of the supporting element that protrudes from the main body. If the longitudinal axis of the main body is inclined with respect to the horizontal, a prism-shaped block 23 is interposed between the nut 22 and the supporting element and is meant to arrange the axis of the screw element 20 in a vertical position. The female thread with which the stem 21 engages can be formed in a nut 22, as shown, or in the block 23, or directly in the body of the supporting element according to requirements.

The end of the threaded stem 21 that protrudes from the supporting element is constituted by a hexagonal head which forms the resting region 6 and allows to operate the screw element 20 so as to vary, by means of its screwing or unscrewing, the useful length of the screw element 20, i.e., the length of the portion of the threaded stem 21 that protrudes from the supporting element.

Advantageously, between the resting region 6 and the second unit 7 there are interposed shock-absorbing means for damping the stresses that are transmitted from the first unit 4 to the second unit 7 or vice versa in case of seismic events. The shock-absorbing means comprise a body 30 which is made of plastically deformable material.

The body 30 is advantageously cap-shaped, so that it can be fitted on the end of the screw element 20 that forms the resting region 6.

In this case, the outer lateral surface of the body 30 has a hexagonal transverse cross-section, so as to allow nonetheless to operate the screw element 20 in order to vary the elevation of the resting region 6.

As an alternative, the body 30 can be simply constituted by a block which is associated with the second unit 7 at its portion that is meant to rest on the resting region 6 or otherwise by a block which is interposed between the second unit 7 and the resting region 6.

The surface of body 30 that makes contact with the second unit 7 or the surface of said body 30 that makes contact with the head of the screw element 20 has raised portions alternated with recesses in order to increase the plastic deformability of said body 30.

The body 30 can be made of a synthetic material and can be dimensioned so as to be plastically deformable by the stresses produced by seismic activity. In particular, the body 30 can be made of a material known commercially by the trademark Teflon or of a material known commercially by the trademark Nylon.

Figure 1:
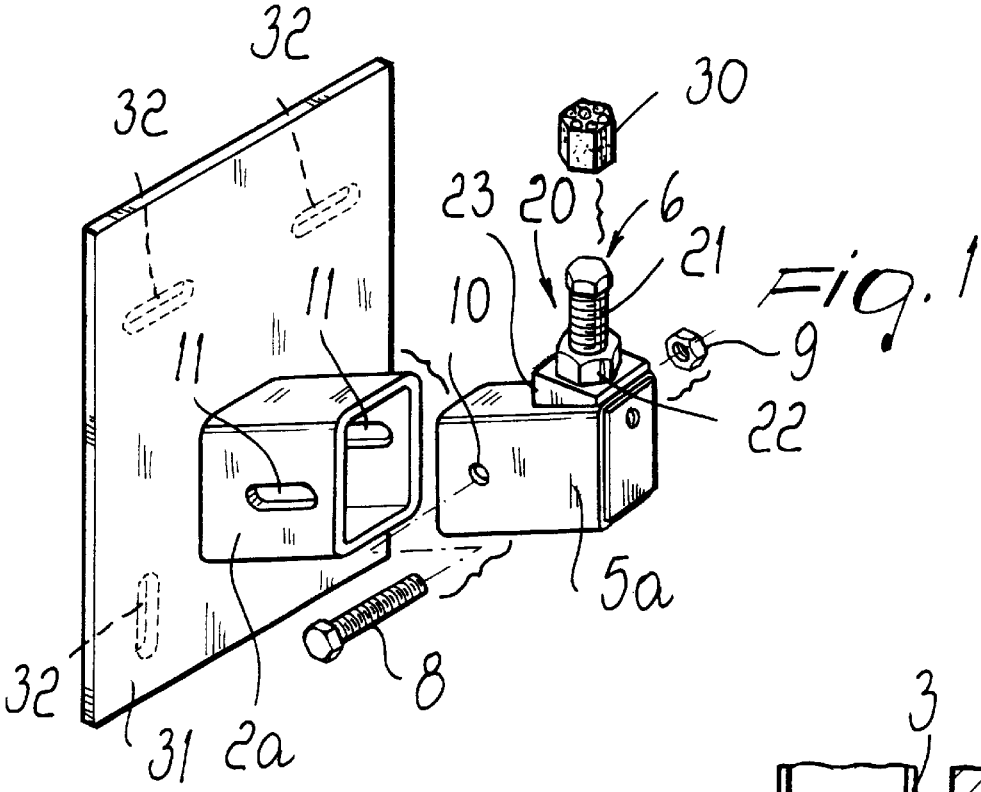
FIG. 1 is an exploded perspective view of the device according to the invention in a first embodiment thereof.
Figure 2:
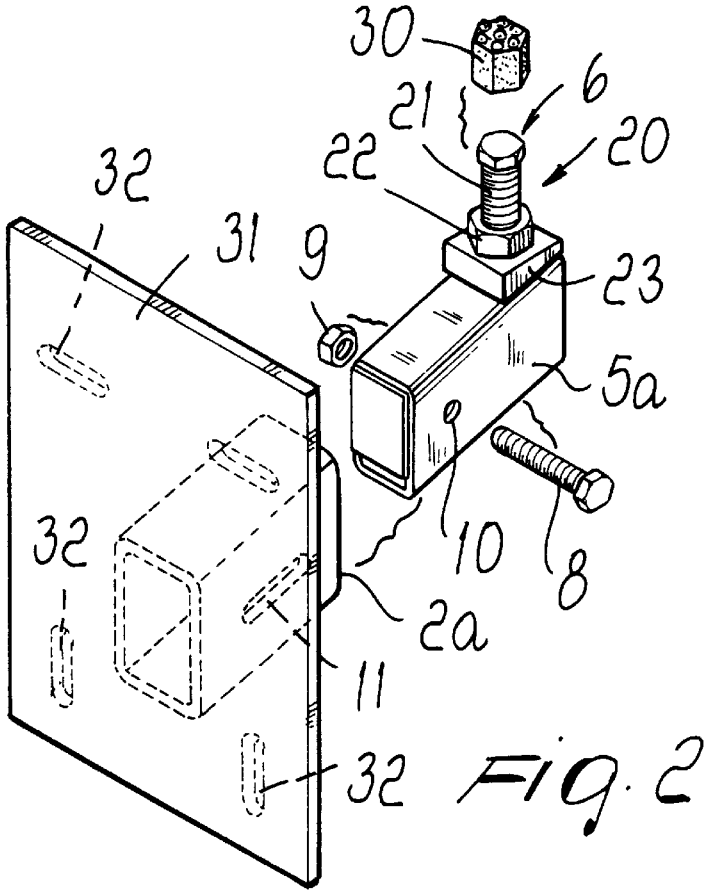
FIG. 2 is an exploded perspective view of the device of FIG. 1, taken from a different angle.
Figure 3:
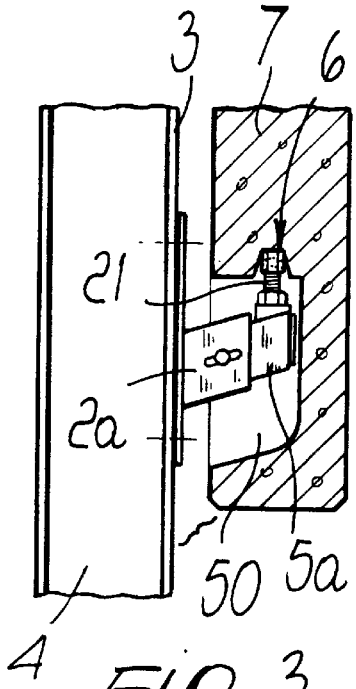
FIG. 3 is a side elevation view of the device according to the invention in its use for connecting a prefabricated panel to a metallic supporting structure.

With particular reference to FIGS. 1 to 3, the main body 2*a* can be fixed, for example by welding, to a face of a fixing plate 31 which is meant to be fixed, for example by bolting, screw anchoring, welding or other conventional fixing methods, to the face 3 of the first unit 4. The fixing plate 31 can be provided with slots or holes 32 in order to facilitate fixing to the face 3 of the unit 4.

According to requirements, the main body 2*a* can be fixed to the fixing plate 31 so that the longitudinal axis of the main body 2*a* is arranged horizontally or inclined with respect to the horizontal, as explained above.

Figure 4:
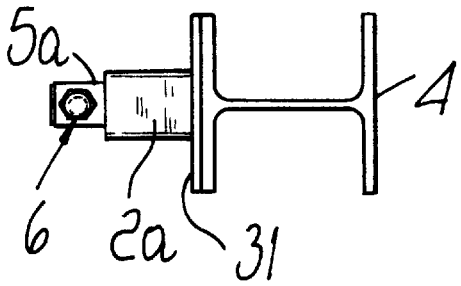
FIGS. 4 to 7 are plan views of different methods of application of the device according to the invention, in different embodiments, to a metal pillar.
Figure 5:
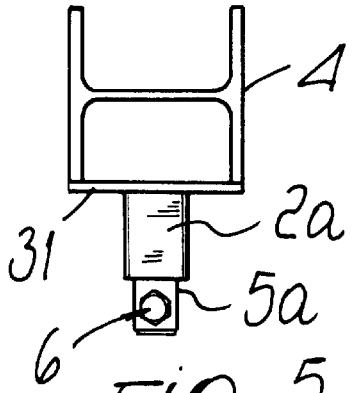
Figure 6:
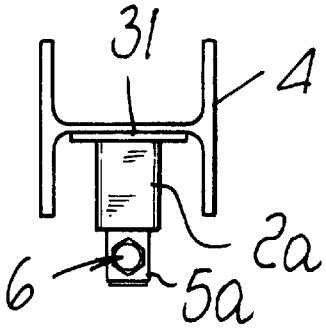

If the first unit 4 is constituted by a metallic profiled element, for example having an H-shaped transverse cross-section, the fixing plate 31 can be fixed to one of the wings of the profiled element, as shown in FIGS. 3 and 4, or can straddle the two wings, as shown in FIG. 5, or can be fixed to the core that joins the two wings of the profiled element, as shown in FIG. 6.

Figure 7:
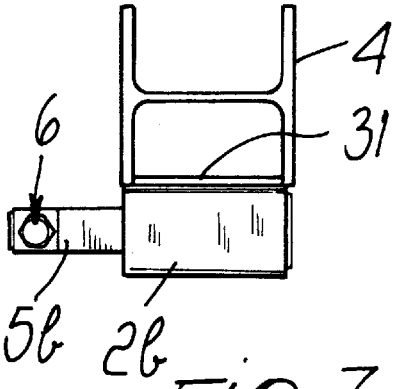

FIG. 7 illustrates the application of the device according to the invention, in another embodiment, to a metallic profiled element. In this embodiment, the main body 2*b*, instead of being fixed to the fixing plate 31 by way of one of its ends, is fixed thereto by means of a portion of its lateral surface. In this case too, the main body 2*b* can be arranged so that its longitudinal axis is horizontal or inclined with respect to the horizontal, as noted above.

Figure 8:
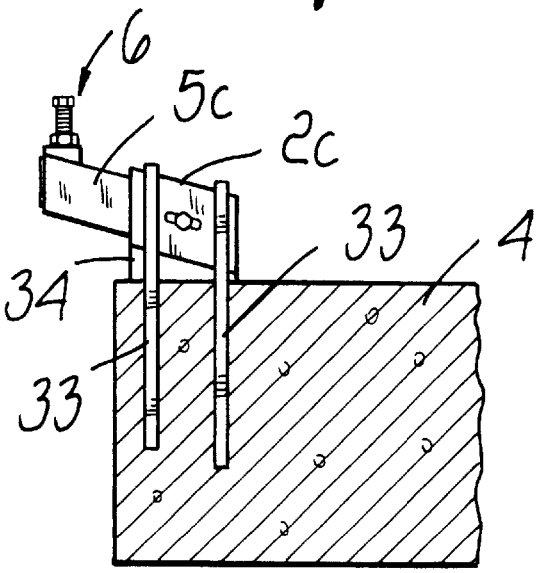
FIGS. 8 and 9 are views of two further embodiments of the device according to the invention in its application to a concrete beam.
Figure 9:
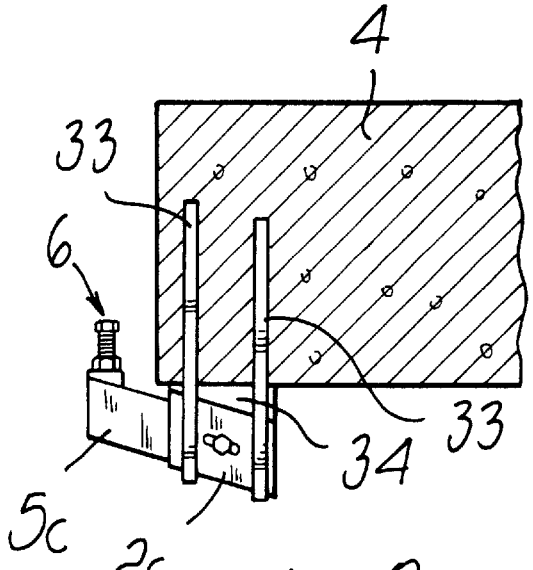

FIGS. 8 and 9 illustrate another embodiment of the device according to the invention, in which the main body 2*c*, instead of being fixed to a fixing plate 31, is rigidly coupled directly to the first unit 4, which is made of concrete, by means of braces 33 which are embedded in the body of the unit 4 during its manufacture. If one wishes the longitudinal axis of the main body 2*c* to lie at an angle to the horizontal, a prism-shaped block 34 is interposed between the first unit 4 and the main body 2*c* and is preferably rigidly fixed to the main body 2*c*.

Figure 10:
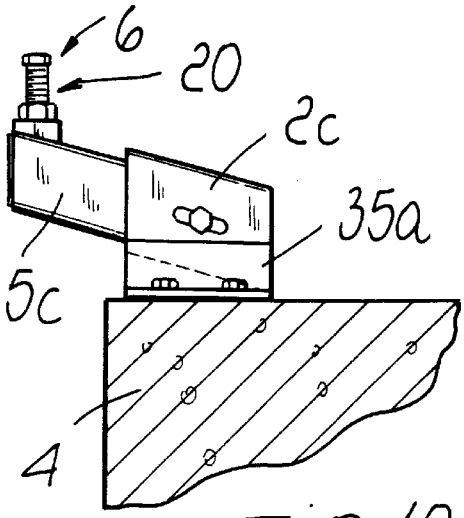
FIG. 10 is a side elevation view of another embodiment of the device according to the invention, applied to a beam or floor slab.
Figure 11:
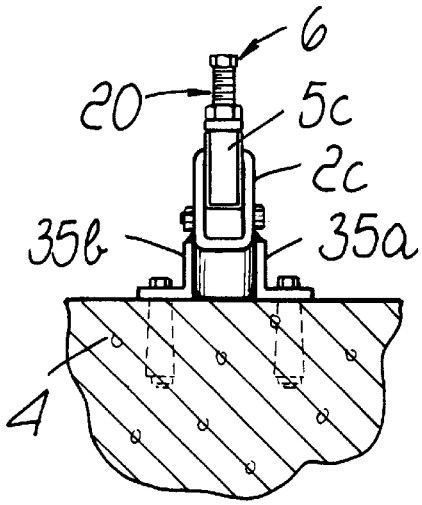
FIG. 11 is a front elevation view of the device of FIG. 10.
Figure 12:
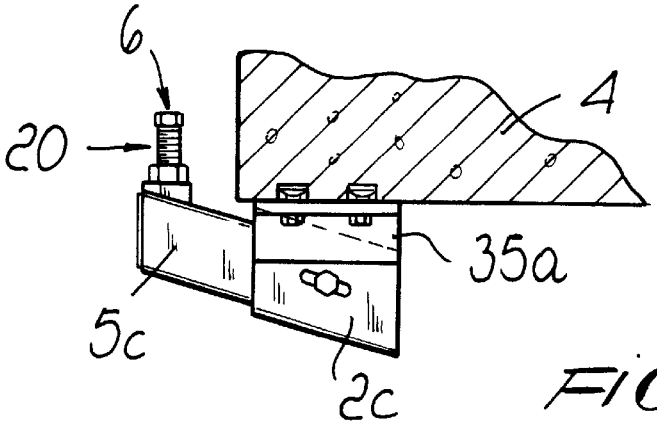
FIG. 12 is a view of a further embodiment of the device according to the invention in its application to a beam or floor slab.

In the embodiment shown in FIGS. 10 to 12, the main body 2*c* is instead fixed to the face 3 of the first unit 4 with the aid of a pair of wings 35*a* and 35*b* which are rigidly fixed, for example by welding, to the main body 2*c* and which are fixed to the unit 4 by means of screw anchors. Also in this case, the longitudinal axis of the main body 2*c* can be horizontal or inclined with respect to the horizontal.

Figure 13:
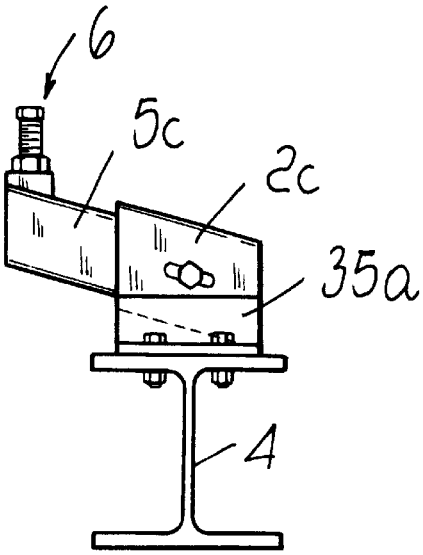
FIGS. 13 and 14 are side elevation views of the application of the devices of FIGS. 10 to 12 to a metallic beam.
Figure 14:
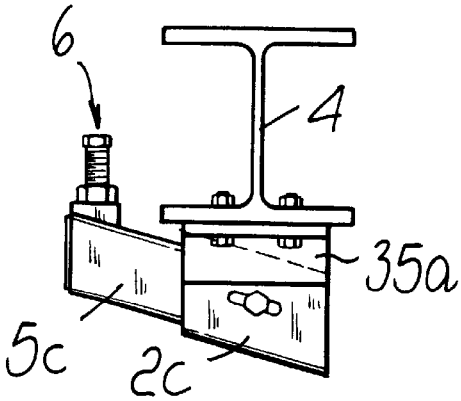

FIGS. 13 and 14 illustrate the application of the device, in the same embodiment shown in FIGS. 10 to 12, to a unit 4 which is constituted by a metallic profiled element.

Figure 15:
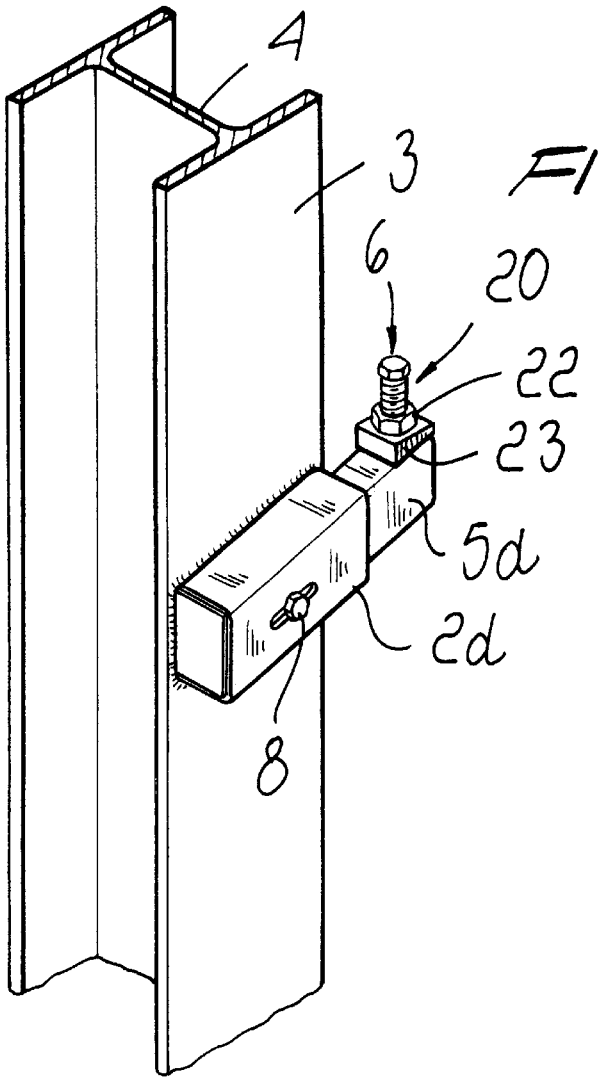
FIG. 15 is a perspective view of a further embodiment of the device according to the invention, applied to a metallic pillar.

In the embodiment shown in FIGS. 15 and 16, the main body 2*d* is rigidly fixed by welding directly to one of the wings of the first unit 4, which is constituted, in the illustrated case, by a metallic profiled element.

In FIG. 16, the main body 2*d* is fixed to the metallic profiled element by also using two tie angles 36.

In the embodiment shown in FIGS. 15 and 16, too, the longitudinal axis of the main body 2*d* can be horizontal or inclined with respect to the horizontal.

In the embodiment shown in FIGS. 17 and 18, the supporting element 5*e*, instead of being inserted in the main body 2*e*, is fitted onto it.

This embodiment allows to achieve, for the device according to the invention, reduced longitudinal dimensions, since it is possible to provide, in the main body 2*e*, at the portion of the screw element 20 that protrudes toward the inside of the supporting element 5*e*, a recess 38 for containing said portion.

In this embodiment, the same reference numerals have been maintained for the elements that correspond to elements that have already been described with reference to FIGS. 1 and 2.

In the various embodiments, the portion of the main body 2*a*, 2*b*, 2*c*, 2*d*, 2*e* and of the supporting element 5*a*, 5*b*, 5*c*, 5*d*, 5*e* that protrudes from the face 3 of the first unit 4 can be partially accommodated within an appropriately provided recess 50 formed in the second unit 7.

The use of the device according to the invention is as follows.

The main body 2*a*, 2*b*, 2*c*, 2*d*, 2*e* is rigidly coupled to the face 3 of a first unit 4 and the supporting element 5*a*, 5*b*, 5*c*, 5*d*, 5*e* is coupled to the main body. By virtue of the possibility to axially move the supporting element 5*a*, 5*b*, 5*c*, 5*d*, 5*e* with respect to the main body 2*a*, 2*b*, 2*c*, 2*d*, 2*e*, and by virtue of the adjustment allowed by the screw element 20, it is possible to vary with great precision the position of the resting region 6 both horizontally and vertically with respect to the first unit 4 and therefore achieve the correct positioning of the second unit 7 that is rested on the resting region 6.

If the shock-absorbing means constituted by the body 30 are interposed between the resting region 6 and the second unit 7, one obtains a damping of the stresses which, in case of a seismic event, are transmitted from the first unit 4 to the second unit 7 or vice versa.

It should be noted that the stop means constituted by the bolt 8, 9 or by the screw 12 prevent the complete extraction of the supporting element 5*a*, 5*b*, 5*c*, 5*d*, 5*e* from the main body 2*a*, 2*b*, 2*c*, 2*d*, 2*e* and therefore achieve high safety, even in case of seismic events, of the resistance of the connection between the units 4 and 7.

In practice it has been observed that the device according to the invention fully achieves the intended aim and objects, since it can be used to perform, in a very simple and precise way, the connection between two units without requiring the presence, inside the unit to which it is applied, of a recess or of a predefined seat for accommodating it.

The device thus conceived is susceptible of numerous modifications and variations, all of which are within the scope of the inventive concept; all the details may furthermore be replaced with other technically equivalent elements.

In practice, the materials used, as well as the dimensions, may be any according to requirements and to the state of the art.

What is claimed is:

1. A supporting device for prefabricated units, comprising a main body which can be fixed to an outer face of a first fixed unit of a building structure, so as to protrude substantially transversely from said outer face, and a supporting element having a portion which forms a resting region for a second prefabricated panel unit to be connected to said first fixed unit so as to be parallel to said first fixed unit and perpendicular to the ground; said supporting element being detachably associated with said main body and being movable and lockable along said main body, towards and away from said outer face of the first fixed unit, in order to vary the position of said resting region with respect to said first fixed unit, with the fixed unit and the second prefabricated panel unit that are arranged perpendicular with respect to the ground, wherein shock-absorbing means are interposed between said resting region and said second prefabricated panel unit, said second prefabricated panel unit having a recess shaped complemetarily with respect to said shock-absorbing means so that said second prefabricated panel unit freely rests upon said shock-absorbing absorbing means of said resting region.

2. The device according to claim 1, wherein said main body and said supporting element substantially constitute a telescopic structure, with a first portion which can be fixed to said first unit and with a second portion which can slide axially with respect to said first portion and forms said resting region for said second unit.

3. The device according to claim 1, wherein said main body is substantially cylindrical, with a polygonal transverse cross-section, said supporting element having a substantially cylindrical body which has a polygonal transverse cross-section and is coupled with play to said main body.

4. The device according to claim 1, wherein said supporting element has a tubular body.

5. The device according to claim 1, wherein said supporting element is inserted axially, with one of its portions, in said main body.

6. The device according to claim 1, wherein said main body is inserted axially, with one of portions thereof in said supporting element.

7. The device according to claim 1, further comprising stop means for stopping the axial sliding of said supporting element with respect to said main body.

8. The device according to claim 7, wherein said stop means comprise a bolt which is arranged transversely to said main body and to said supporting element and passes through a hole formed in the portion of said supporting element that is inserted in said main body and a slot which is elongated in an axial direction and passes through said main body.

9. The device according to claim 7, wherein said stop means comprise at least one screw which is arranged transversely to said main body and to said supporting element and passes through a threaded hole formed in the portion of said main body that is inserted in said supporting element and engages a slot which is elongated in an axial direction and is formed in said supporting element.

10. The device according to claim 1, wherein said main body is fixed to said first unit so that axes of said main body and of said supporting element are substantially horizontal.

11. The device according to claim 1, wherein said main body is fixed to said first unit so that axes of said main body and of said supporting element are at an angle to the horizontal and rise toward the portion of said supporting element that protrudes from axial dimensions of said main body.

12. The device according to claim 1, wherein said resting region is formed proximate to an end of said supporting element that protrudes from axial dimensions of said main body.

13. The device according to claim 1, wherein it comprises adjustment means for adjusting the elevation of said resting region.

14. The device according to claim 13, wherein said adjustment means comprise a screw element which lies in a substantially vertical direction and is associated with said supporting element; said screw element forming, with an end thereof that protrudes from said supporting element, said resting region for the second unit and having a useful length which can vary in order to vary the elevation of said resting region.

15. The device according to claim 14, wherein said main body has, at its end that is inserted in said supporting element, a recess for accommodating the portion of said screw element that is located inside said supporting element.

16. The device according to claim 1, wherein said shock-absorbing means comprise a body made of plastically deformable material which is interposed between said resting region of the supporting element and said second unit.

17. The device according to claim 16, wherein said plastically deformable body is cap-shaped and is fitted over the end of said screw element that forms said resting region.

18. The device according to claim 17, wherein a surface of said plastically deformable element that makes contact with said second unit and/or a surface of said plastically deformable body that makes contact with said supporting element or said screw element has raised portions alternated with recesses in order to increase the plastic deformability of said plastically deformable body.

19. The device according to claim 1, wherein said main body is rigidly fixed to a fixing plate which in turn can be fixed to said face of the first unit.

* * * * *